US007122230B1

(12) United States Patent
Maskell

(10) Patent No.: US 7,122,230 B1
(45) Date of Patent: Oct. 17, 2006

(54) CONTROLLED DIAMETER COLLAPSIBLE ARTIFICIAL CHRISTMAS TREE

(76) Inventor: Thomas Joseph Maskell, 2585 Spitler Rd., Poland, OH (US) 44514

( * ) Notice: Subject to any disclaimer, the term of this patent is extended or adjusted under 35 U.S.C. 154(b) by 272 days.

(21) Appl. No.: 10/866,061

(22) Filed: Jun. 12, 2004

(51) Int. Cl.
*A47G 33/06* (2006.01)
*A41G 1/00* (2006.01)

(52) U.S. Cl. ..... 428/20; 428/18

(58) Field of Classification Search ..... 428/18, 428/19, 20; D11/118
See application file for complete search history.

(56) References Cited

U.S. PATENT DOCUMENTS

| | | | | |
|---|---|---|---|---|
| 1,683,637 | A | | 9/1928 | Trimpe |
| 2,708,324 | A | | 5/1955 | Wedden |
| 3,030,720 | A | | 4/1962 | Osswald |
| 3,574,102 | A | | 4/1971 | Hermanson |
| 3,616,107 | A | | 10/1971 | Kershner |
| 3,639,196 | A | | 2/1972 | Hermanson |
| 3,806,399 | A | * | 4/1974 | Cocjin ..... 428/8 |
| 4,093,758 | A | | 6/1978 | Weskamp |
| 4,140,823 | A | | 2/1979 | Weskamp |
| 4,144,364 | A | | 3/1979 | Tice |
| 4,659,597 | A | | 4/1987 | Lau |
| 5,652,032 | A | | 7/1997 | Kaczor |

FOREIGN PATENT DOCUMENTS

| | | | |
|---|---|---|---|
| CH | 670196 A | * | 1/1900 |

* cited by examiner

*Primary Examiner*—Jennifer C. McNeil
*Assistant Examiner*—Aaron Austin

(57) ABSTRACT

The invention relates to an artificial tree that can be reduced in diameter by rotating its branches inward and along the length of the tree's trunk. The rotation of the branches is initiated by the rotation of the threaded inner core which is coaxially placed within the tree's outer trunk shell. This rotational motion is translated into a linear motion along the threaded inner core by the restriction of the rotational movement of a threaded branch translator placed on the threaded inner core. The restriction is caused by branch extenders pivotally attached to the branch translator and passing through openings located on the tree's outer trunk shell. The linear motion of the translator causes a multitude of pivotally attached branches radiating from the tree's trunk to rotate inward and along the tree's trunk. Thus, the diameter of the tree is reduced for easier transport and storage.

5 Claims, 9 Drawing Sheets

(view E, Fig4)

(view A-A', Fig3)

(view B-B', Fig3)

CONTROLLED DIAMETER COLLAPSIBLE ARTIFICIAL CHRISTMAS TREE

CROSS-REFERENCE TO RELATED APPLICATION

Not Applicable

FEDERALLY SPONSORED RESEARCH

Not Applicable

SEQUENCE LISTING OR PROGRAM

Not Applicable

BACKGROUND OF THE INVENTION

Field of Invention

This invention relates to artificial trees, specially artificial Christmas trees which can be reduced in diameter by a controlled rotation of its branches inward toward its trunk.

BACKGROUND OF THE INVENTION

Originally, artificial Christmas trees were produced such that the owner was required to assemble and disassemble the tree upon each use. After assembly, the trees could be trimmed with an array of decorations. These trees quickly became a popular alternative to live trees which required considerable care, posed a fire hazard and required special disposal procedures.

The popularity of the artificial trees soon spread to the commercial sector. Now, many of these trees are used in stores, offices and commercial displays. The cost in money and time to assemble and disassemble the tree is considerable. It can, after repeated use, exceed the original cost of the tree. The need for a tree that does not require assembly and disassembly became apparent.

Beyond assembly and disassembly, the cost of decorating and un decorating the tree each year was an even bigger expense. A tree that could be decorated once and then stored in the decorated state for repeated use would be a significant advance. It would allow for an entirely new enterprise that delivered pre decorated trees to commercial establishments. These trees could be quickly and inexpensively set up on a seasonal basis. When the season was ended, they could just as quickly and inexpensively be removed and stored for reuse.

These permanently decorated trees would save money and time. They would create new commercial opportunities. But, as described below, such a tree does not presently exist.

The search for an artificial collapsible Christmas tree has been in progress for more than three quarters of a century. Beginning in 1928, E. H. Trimpe (U.S. Pat. No. 1,683,637, Sep. 11, 1928) designed a simple wire branch tree. The wire branch is threaded through the central trunk of the tree. It is collapsed or extended by bending the wire branch. The flaws in the design are obvious. First, the wire branches lack a realistic look. The wire used in the branches is thin. This allows the branches to be alternately bent into the collapsed and extended position. But the thinness also creates a weak branch that cannot support a full array of Christmas decorations. The repeated bending of the branch with use also causes metal fatigue. The fatigue ultimately causes the branch to fail. Finally, each branch has to be adjusted separately. They require an individual force be applied to each branch to change its position. There is no coordination between branches during and after movement.

Trimpe created a collapsible tree where the branches were bent to reduce the diameter of the tree. However, its major deficiencies of metal fatigue, individual branch movement and branch weakness preclude its use as a permanently decorated tree.

On Apr. 6, 1971, T. Hermanson improved on the Trimpe concept with U.S. Pat. No. 3,574,102. Hermanson's branches are inserted into a hollow central tree trunk. The wire branches fit loosely into the trunk. This allows them to be individually rotated into the collapsed and extended positions. On Feb. 1, 1972, T. Hermanson improved on his own invention with U.S. Pat. No. 3,639,196. The improvement focuses on how the branch attaches to the central tree trunk. In both inventions, the basic improvement over Trimpe is that the branches are rotated. This eliminates the bending. Thus, the wire branches do not fatigue and fail with repeated use. Also, the branches can be made stronger to support more decorations. However, the branches are still individually rotated. They are also loosely set in the trunk. Thus, they have only two set positions: fully collapsed and fully extended. These positions represent the end points of their rotation. The extended position is held firm by gravity with the tree in a vertical stance. The collapsed position is not defined but is established by the end point of rotation.

On May 17, 1955, M. J. Wedden was awarded U.S. Pat. No. 2,708,324 entitled "Collapsible Tree with Individually Hinged Branches on Hollow Tube." On one end of the branch is a simple hook-shaped stem. The stem wraps around a pivot bar. The bar attaches to the tree's trunk section. Thus, the branch can be rotated 90 degrees. Its initial open position being perpendicular to the trunk. Its subsequent, collapsed position being essentially parallel to the trunk. The branch moves freely and loosely between the collapsed and open position. The major contribution of Wedden is the modular nature of the linkage between the branch and the trunk. It does not correct the basic flaws of individual activation, loose movement, and only two set positions.

On Apr. 24, 1962, Osswald et. al. were awarded U.S. Pat. No. 3,030,720. The Osswald approach is to extend the branch into a hollow central tree trunk. The branch pivots at the point of contact with the trunk. The branch, pivot point and trunk are permanently attached to each other. However, this approach does not correct the basic flaws of Wedden and Hermanson. The branches are still individually activated, move loosely, and only have two set positions.

On Oct. 26, 1971, William A. Kershner was awarded U.S. Pat. No. 3,616,107. This is a unique variation on the rotation mechanism of the branch. But the most important contribution is the introduction of a branch mounting collar. The collar contains the branch rotating mechanisms. It also can be stacked and attached to the trunk structure of the tree. This allows ease of production and of assembly. However, it does not address the basic flaws inherent in Hermanson, Wedden, and Osswald.

On Jun. 6, 1978, Weskamp et.al. were awarded U.S. Pat. No. 4,093,758. It is a variant of the hooked branch approach of Wedden. The folding mechanism is essentially the same as Wedden. The difference is that it was modular in design. The module can be inserted in the tree's trunk. This makes for ease of manufacture and flexibility of branch placement. No other advantages of Wedden over existing art are apparent.

On Feb. 20, 1979, Robert J. Westkamp was awarded U.S. Pat. No. 4,140,823. This combines the hooked design of Wedden with the collared design of Kirshner. The branch holder is in the form of a collar. The collar is attached to the trunk. This collar consists of several hooked branches placed at different positions around the collar. The collapsing mechanics of the hooked branches are the same as Wedden (U.S. Pat. No. 2,708,324) and Westkamp (U.S. Pat. No. 4,093,758). Thus, it suffers the same deficiencies presented above for those inventions.

On Mar. 13, 1979, William G. Tice was awarded U.S. Pat. No. 4,144,364. Tice designed a completely new branch collapsing mechanism. It consists of a hollow central trunk. The hollow trunk consists of two concentric tubes with strategically placed openings. The branches are placed within these openings. By moving one tube in relation to the other, the branch is moved from the collapsed to the extended position. This mechanism allows all the branches to move at once. This mechanism overcomes one deficiency of the prior art in that branches are no longer moved individually. However, it creates other significant problems. Because of the complexity of the mechanism, there are a limited number of branches possible. Also, the mechanism requires significant force to move the branches. This occurs because the force to move the branch occurs near the pivot point of the branch. In previous inventions, the force required to move the branch can be applied anywhere along the length of the branch. This allows the user to take advantage of leverage which reduces the force required to collapse the tree. Also, it is not clear that the tree can be collapsed in the upright position, or if it can, it would be a very difficult task.

Thus, Tice eliminates one deficiency of the prior art but creates three more: complexity of design, excess force and difficulty of activation in the upright position with fully decorated branches.

On Jul. 29, 1997, Sheila Kaczor et. al. were awarded U.S. Pat. No. 5,652,032. The mechanism is similar to Tice. The difference is in how the branch attaches to the inner tube of the two tube trunk. Like Tice, the tubes move in relation to one another which activates the branch movement. This mounting technique provides for added flexibility in placing the branches onto the trunk. However, it also adds to the force required to move the branches because the point of force application is moved closer to the pivot point. Kaczor's design appears to allow for the attachment of more branches to the trunk than does Tice. However, it retains all the other deficiencies of Tice and adds the need for additional force to move the branches.

While both Tice and Kaczor provide for a multiple branch activation mechanism, the mechanism is problematic on three levels. First, the mechanism appears to only allow for two positions. The branches align parallel to the trunk or perpendicular to the trunk. Second, the activation requires a vertical displacement of the concentric trunk members to move the branches. A task difficult to accomplish with the tree upright. Third, excessive force is needed to move the branches because it is applied so close to the pivot point. This creates a stressful and clumsy movement of the branches during their transition between their deployed and collapsed positions.

Finally, on Apr. 21, 1987, Arthur Lau was awarded U.S. Pat. No. 4,659,597. This unique approach to a collapsible tree is fashioned after an umbrella. A system of pivots and links raises and lowers the branches. This allows the branches to move in unison. However, the mechanism fails to solve the basic problems of smooth operation, controlled tree diameter, a unified branch movement, ease of operation and an ability of the branches to withstand the stress of a fully decorated closure and storage.

It is clear from the descriptions above that there is no one invention that provides a Christmas tree that can be substantially collapsed for storage with its decorations in place. The branches are either too weak as in Trimpe (U.S. Pat. No. 1,683,637), or too loosely rotated as in T. Hermanson (U.S. Pat. No. 3,574,102 and U.S. Pat. No. 3,639,196), M. J. Wedden (U.S. Pat. No. 2,708,324), Osswald et. al. (U.S. Pat. No. 3,030,720), William A. Kershner (U.S. Pat. No. 3,616,107), and Weskamp et.al. (U.S. Pat. No. 4,093,758 and U.S. Pat. No. 4,140,823). This loose rotation does not firmly maintain a fully decorated branch in the closed position. Also, the fact that each branch rotates individually makes the process of rotating the branches cumbersome.

Tice (U.S. Pat. No. 4,144,364) and Kaczor et. al. (U.S. Pat. No. 5,652,032) overcomes the individuality of branch movement. They link the movement of the branches to the movement of two concentric central trunk members. This moves all the branches at one time. However, a branch fully loaded with decorations provides considerable resistence to this movement. It is unclear that such a mechanism works with a fully decorated tree. And it is difficult to see how it can be activated with a fully decorated tree in it upright position. The same is true of Lau (U.S. Pat. No. 4,659,597).

BACKGROUND OF THE INVENTION

OBJECTS AND ADVANTAGES

The object of this invention is to create a Christmas tree that can be quickly and easily stored fully decorated. Such a tree requires the following advantages:

1. A collapsing mechanism that will substantially reduce the diameter of the tree.
2. Branches which can be made strong enough to support decorations.
3. A method of branch movement powerful enough to overcome the weight of a fully decorated branch.
4. A smooth and continuous branch movement that will not disturb the applied decorations
5. A mechanism that allows for a multitude of branch positions from fully extended to fully collapsed.
6. A collapsing mechanism that is easily activated and controlled.
7. A collapsing mechanism that moves all the branches simultaneously.
8. A mechanism that allows the tree to be collapsed in the upright position.
9. A tree that can be easily packed and transported to a storage area.
10. A design flexible enough to accommodate a multitude of branch and tree configurations.

Still further objects and advantages will become apparent from a consideration of the ensuing description and drawings.

SUMMARY

In accordance with the present invention an artificial Christmas tree that can be reduced in diameter, fully decorated, in the upright position, such that it can be stored for future use without appreciable disassembly.

DRAWINGS—FIGURES

DRAWINGS—REFERENCE NUMERALS

| | |
|---|---|
| 20 | Tree top |
| 25 | Branches |
| 30 | Trunk |
| 31 | Outer trunk shell |
| 32 | Branch guide |
| 33 | Outer pivot bar |
| 34 | Outer shell slot |
| 35 | Trunk core restraint |
| 36 | Threaded inner core |
| 37 | Inner core unthreaded cap |
| 38 | Inner core gear |
| 39 | Inner core unthreaded bottom |
| 40 | Tree base |
| 41 | Tree base housing |
| 42 | Drive gear |
| 43 | Drive axle |
| 44 | Drive guide |
| 45 | Drive connector |
| 46 | Tree base trunk core restraint |
| 50 | Branch translator assembly |
| 51 | Branch extender |
| 52 | Branch extender slot |
| 53 | Inner pivot bar |
| 54 | Threaded branch translator |

DETAILED DESCRIPTION—FIGS. 1 THROUGH 10

Figure 1:
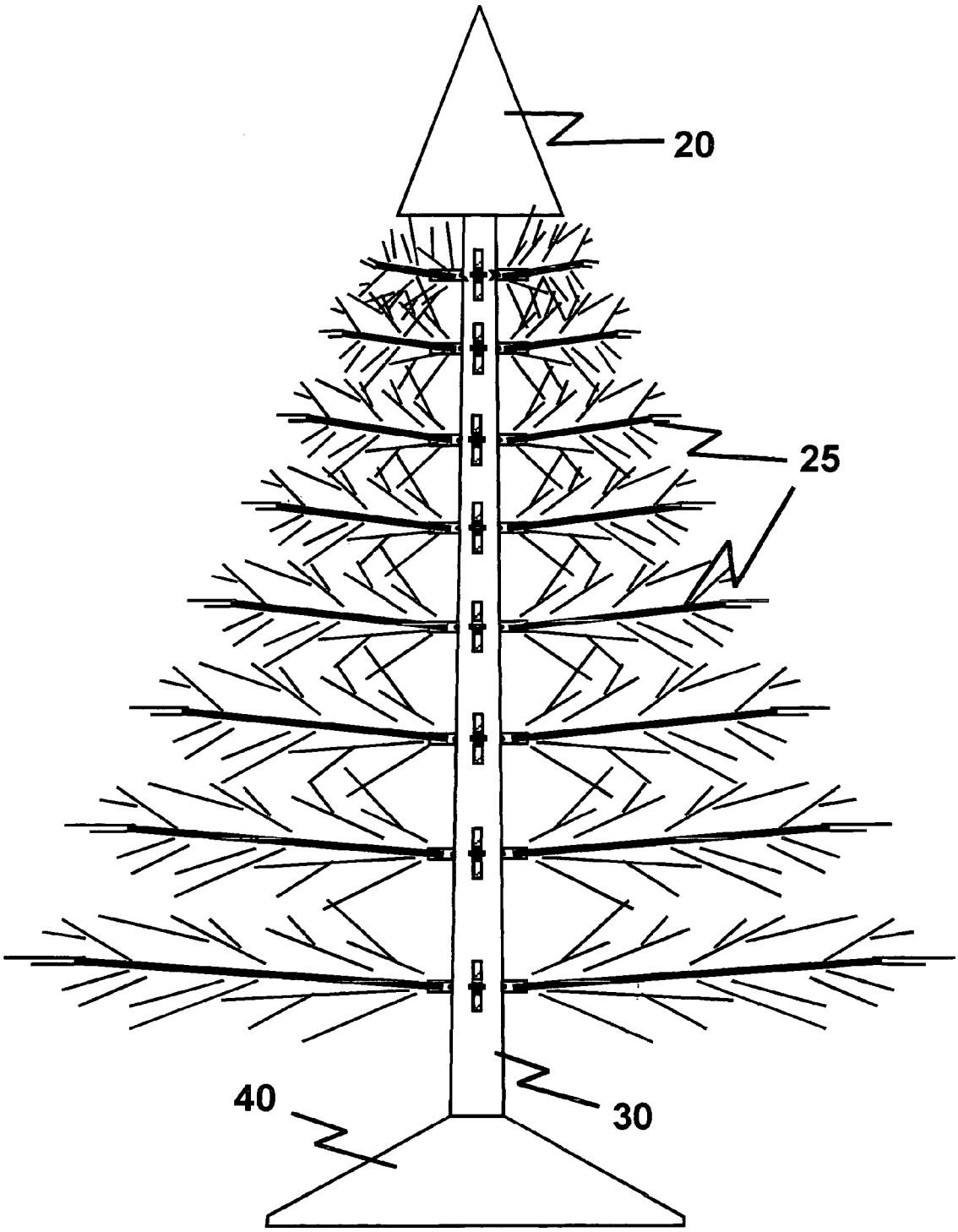
FIG. 1 illustrates an artificial Christmas tree depicting its main components.

FIG. 1 illustrates the major components of a typical artificial Christmas tree. It consists of a tree base (40), a trunk (30), branches (25) and a tree top (20). The tree base (40) stabilizes the tree in the upright position. The trunk (30) is the main vertical shaft to which the branches (25) and tree top (20) are attached. Both the branches and tree top can be either permanently attached to the trunk, or removable from the trunk.

Figure 2:
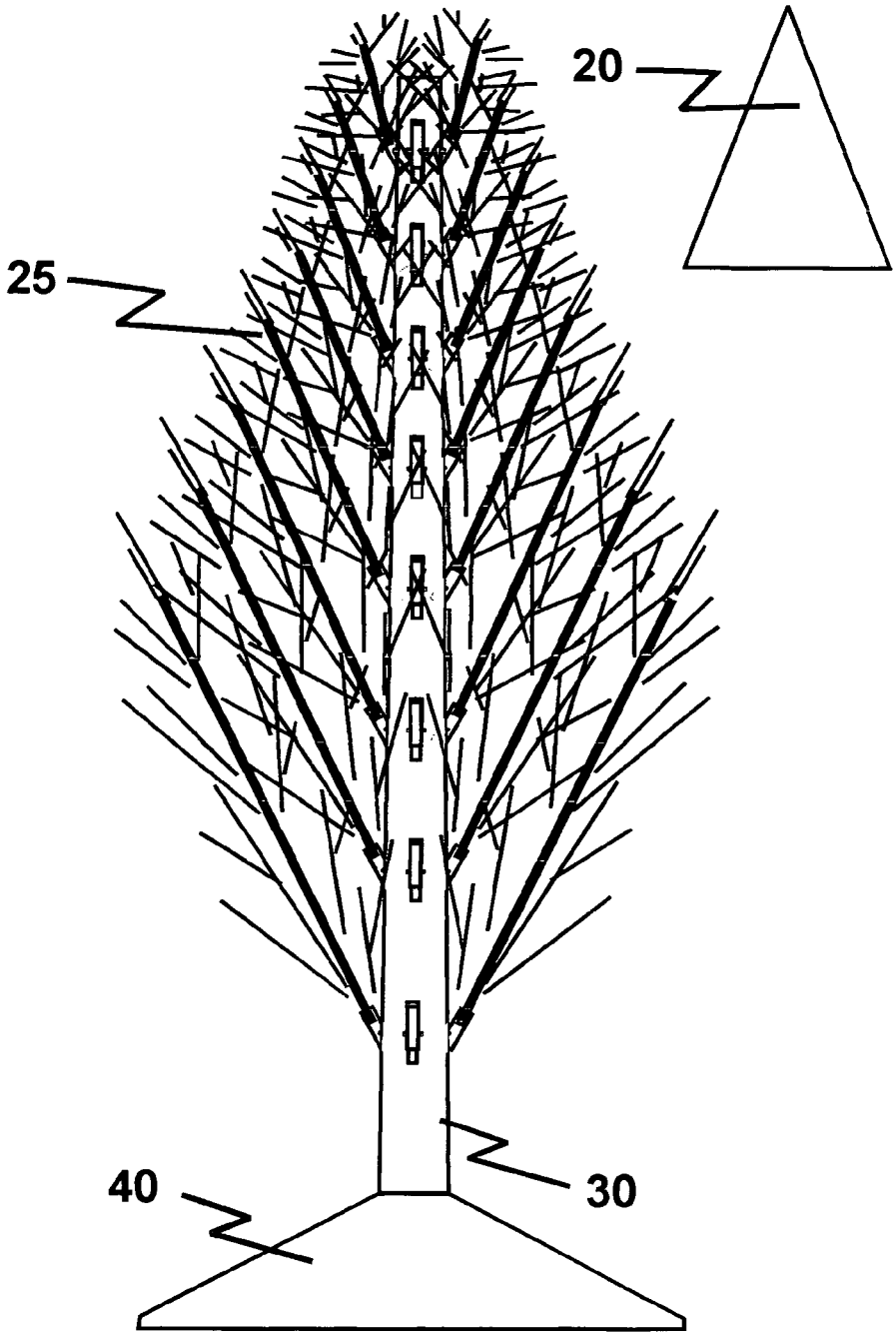
FIG. 2 illustrates an artificial Christmas tree with its branches in the collapsed position and its top removed.

FIG. 2 illustrates a collapsed artificial Christmas tree. The tree is collapsed in the upright position. This reduces its diameter. The tree top (20) is removed to decrease the tree's height. Removing the tree top also prevents it from restricting the movement of the upper branches during the collapsing process. The removal of the tree top is optional.

Figure 3:
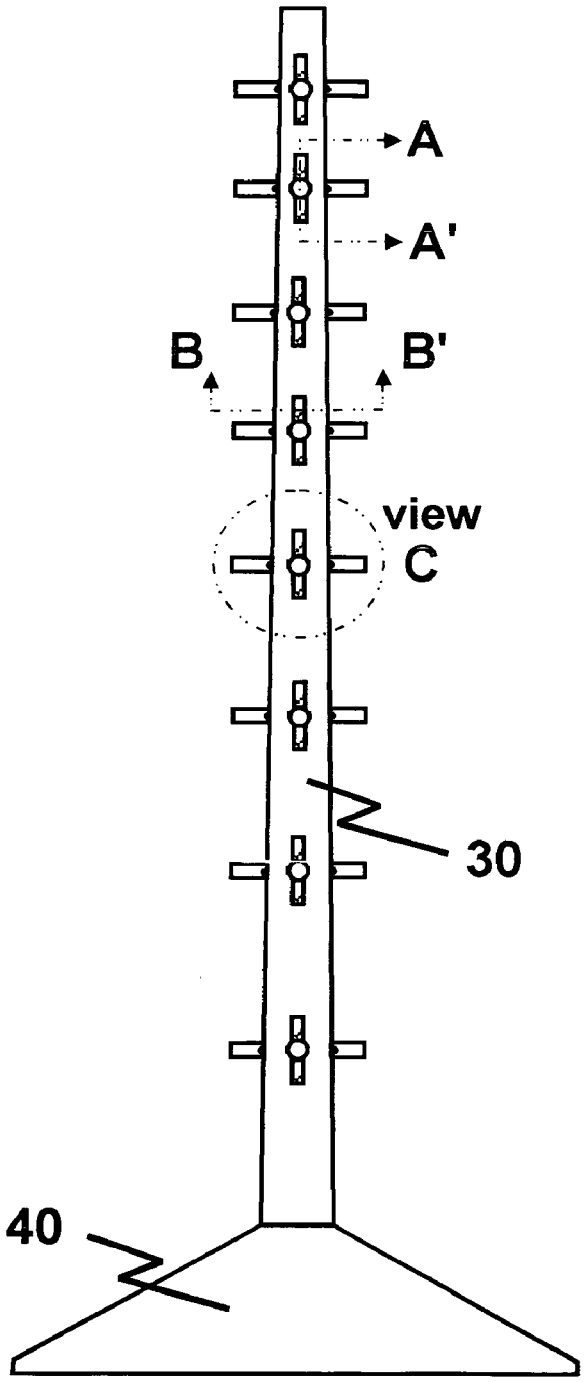
FIG. 3 illustrates the trunk and base components of an artificial Christmas tree.

FIG. 3 isolates and illustrates the trunk (30) and tree base (40) components of the tree. In FIG. 3 the tree top and branches are removed. This is an option. However, the trunk (30) is permanently attached to the tree base (40). The tree base provides stability for the trunk. It also contains the driving mechanism for collapsing the branches. The trunk (30) is the main vertical structure of the tree. It provides the means for attaching the branches. It also contains the linkages necessary to collapse the branches.

Figure 4:
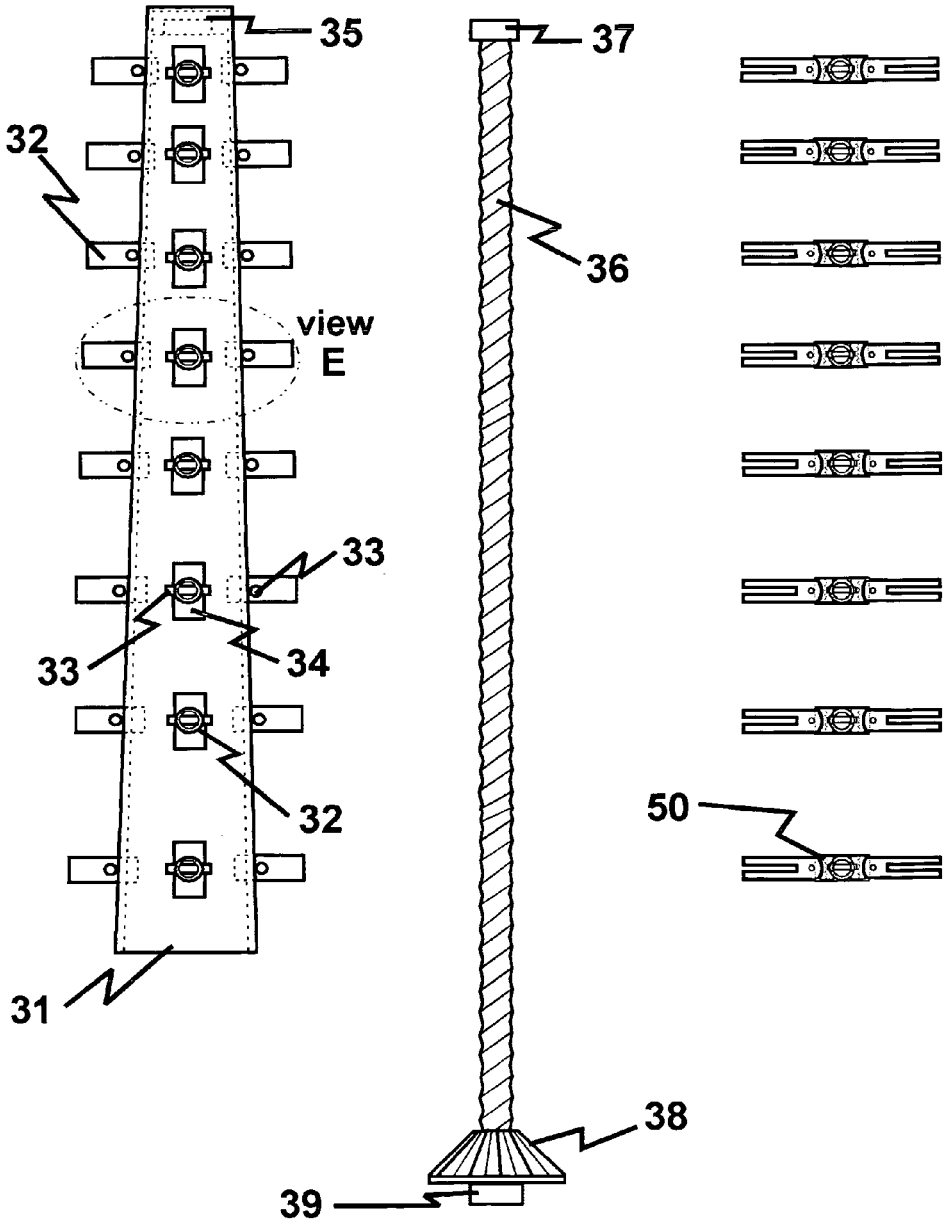
FIG. 4 illustrates the main components of the trunk of an artificial Christmas tree.

FIG. 4 illustrates the components of the trunk (FIGS. 3, 30). The trunk consists of an outer trunk shell (31), a threaded inner core (36) and the branch translator assemblies (50). The outer trunk shell contains a multitude of outer shell slots (34). The outer shell slots allow for the vertical rotating movement of the branch guide (32). The branch guide rotates around the outer pivot bar (33). The outer pivot bar is attached to the outer surface of the outer trunk shell. Within the outer trunk shell is the threaded inner core (36). This threaded inner core extends the length of the outer trunk shell and into the tree base. The threaded inner core is concentric to the outer trunk shell. At the top of the threaded inner core is the inner core unthreaded cap (37). This cap (37) fits in and freely rotates within the trunk core restraint (35) located at the top of the outer trunk shell (31). At the bottom of the threaded inner core is the inner core unthreaded bottom (39). The inner core unthreaded bottom (39) fits in and freely rotates within the tree base trunk core restraint (46, FIG. 6, not shown in FIG. 4). Just above the inner core unthreaded bottom (39) is the inner core gear (38). The inner core gear is permanently attached to the threaded inner core. Threaded onto the threaded inner core are the branch translator assemblies (50). A multitude of these assemblies (50) are placed onto the inner core (36) and aligned with the outer shell slots (34) and the branch guides (32).

Figure 5:
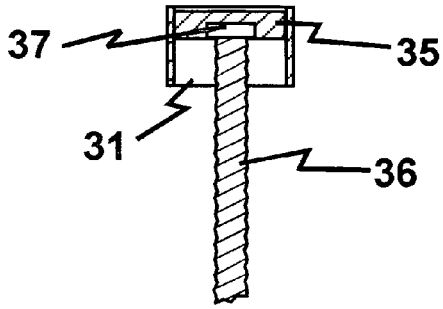
FIG. 5 illustrates a cross sectional view of the top of the tree's trunk.

FIG. 5 is a cross sectional view through the outer trunk shell (31). This view illustrates the fit of the inner core unthreaded cap (37) of the threaded inner core (36) into the trunk core restraint (35). Both the core cap (37) and the core restraint (35) are round. This allows the core (36) and the core cap (37) to rotate freely in the core restraint (35).

Figure 6:
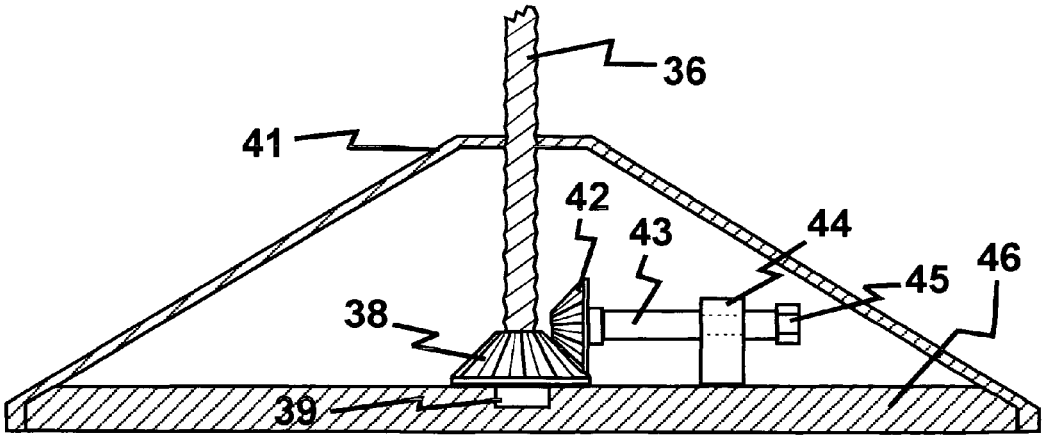
FIG. 6 illustrates a cross section of the tree's base with the bottom part of the trunk in place.

FIG. 6 is a cross sectional view through the tree base (FIGS. 3, 40). The tree base consists of a tree base housing (41), a drive gear (42), a drive axle (43), a drive guide (44), a drive connector (45), and a tree base core restraint (46). Into the tree base is extended the threaded inner core (36) of the trunk (FIGS. 3, 30). The inner core unthreaded bottom (39) of the threaded inner core (36) fits into the tree base core restraint (46). Both the inner core unthreaded bottom (39) and the core restraint (46) are round. This allows the threaded inner core (36) and the inner core unthreaded bottom (39) to rotate freely in the tree base core restraint (46). The drive gear (42) is engaged with the inner core gear (38). The drive axle (43) transmits rotational motion from the drive connector (45) to the drive gear (42). The drive guide (44) maintains contact between the drive gear (42) and the inner core gear (38). The drive connector (45) connects the mechanism to any appropriate driving force (not shown).

Figure 7:
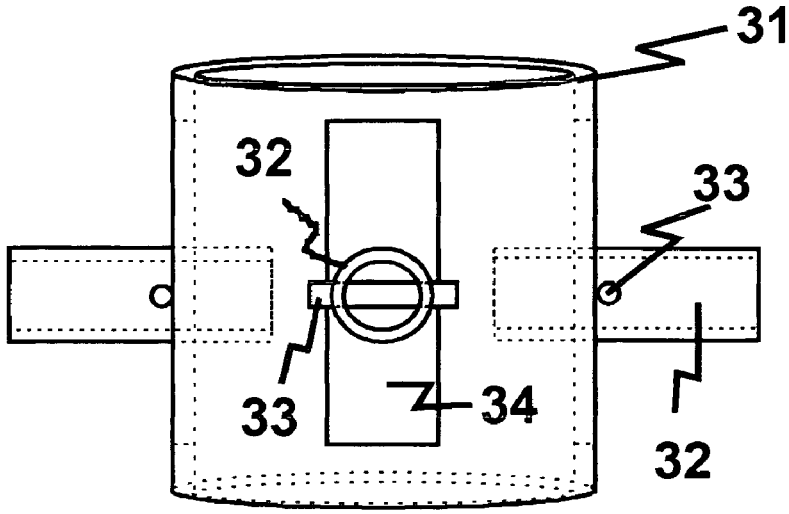
FIG. 7 illustrates a section of the outer shell of the trunk with its pivotally attached branch guides.

FIG. 7 is view E from FIG. 4. It is a closer view of a slotted section of the outer trunk shell (31). It illustrates the outer shell slots (34), the branch guides (32), and the outer pivot bars (33). The outer pivot bars (33) are attached to the outer surface of the outer trunk shell (31). The outer pivot bars (33) also pass through the hollow branch guides (32). The branch guides (32) are held in place by and rotate around the outer pivot bars (33). The outer shell slots (34) provide for the vertical rotational movement of the branch guides (32). These branch guides hold the branches (FIGS. 1, 25) and transmit the rotational movement to the branches.

Figure 8:
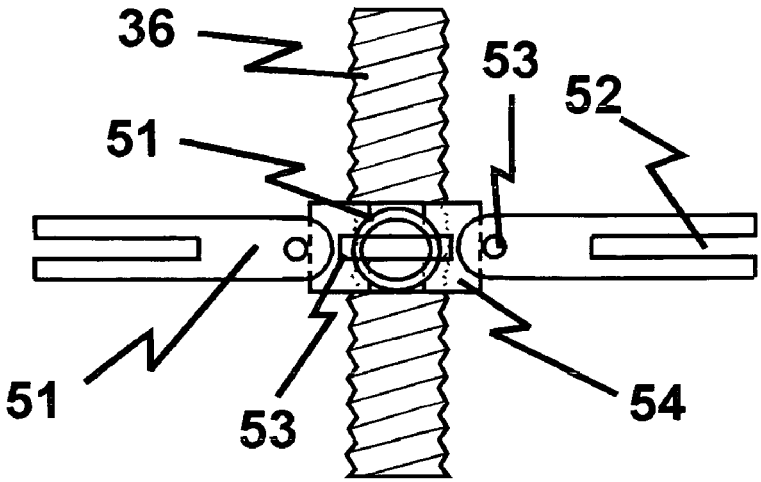
FIG. 8 illustrates the threaded inner core of the trunk with its attached branch translator and pivotally attached branch extenders.

FIG. 8 illustrates the placement of a branch translator assembly (FIGS. 4, 50) on the threaded inner core (36). The branch translator assembly (50) consists of a branch extender (51), an inner pivot bar (53), and a threaded branch translator (54). The branch translator assembly (50) is threaded onto the threaded inner core (36) by way of the threaded branch translator (54). The connection is similar to that of a threaded bolt and nut. The threaded inner core (36) being the bolt. The threaded branch translator (54) being the nut. The inner pivot bar (53) is attached to the threaded branch translator (54). This inner pivot bar (53) passes through the branch extender (51) and attaches that branch extender (51) to the threaded branch translator (54). The branch extender (51) is free to rotate in relation to the inner pivot bar (53). The branch extender is slotted (52). The slotted branch extender (51) is shaped and sized to fit within the branch guide (32, not shown). The branch extender slot (52) in the branch extender (51) allows the branch extender to slide past the outer pivot bar (33, not shown).

Figure 9:
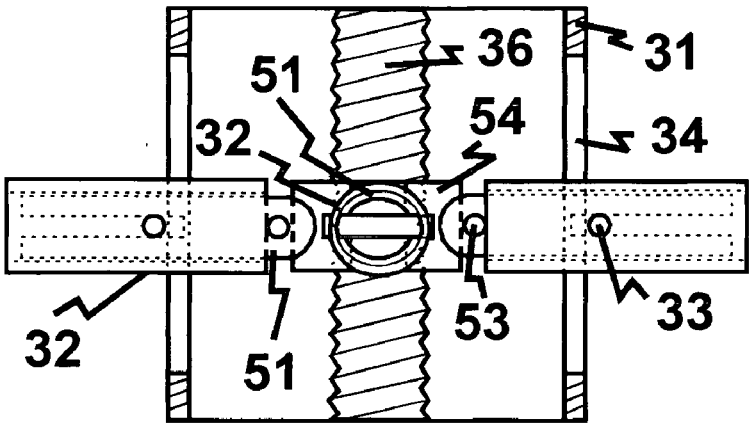
FIG. 9 illustrates a cross section of part of the assembled trunk with the outer trunk shell, the branch guides, the threaded inner core, branch translator and the branch extenders.

FIG. 9 is a cross sectional view through the outer trunk shell (31) illustrating the placement of the branch translator assembly (FIGS. 4, 50) on the threaded inner core (36) and the placement of its branch extenders (51) within the branch guides (32). The view is identified on FIG. 3 as A—A. FIG. 9 shows how the branch extender (51) fits into the branch guide (32) and bypasses the outer pivot bar (33) by way of the branch extender slot (52).

Figure 10:
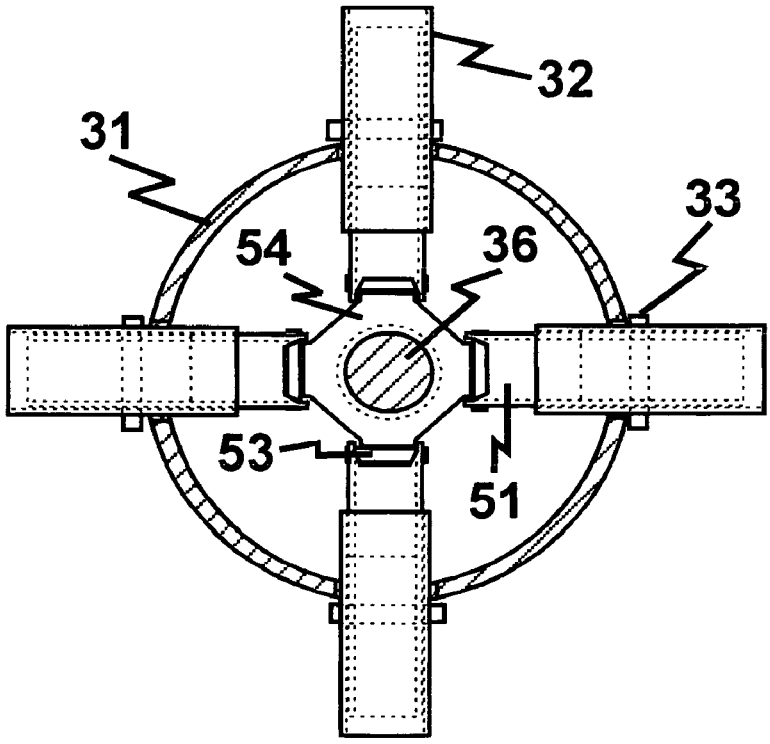
FIG. 10 illustrates a downward view of part of the assembled trunk with the outer trunk shell, the branch guides, the threaded inner core, branch translator and the branch extenders.
Figure 11:
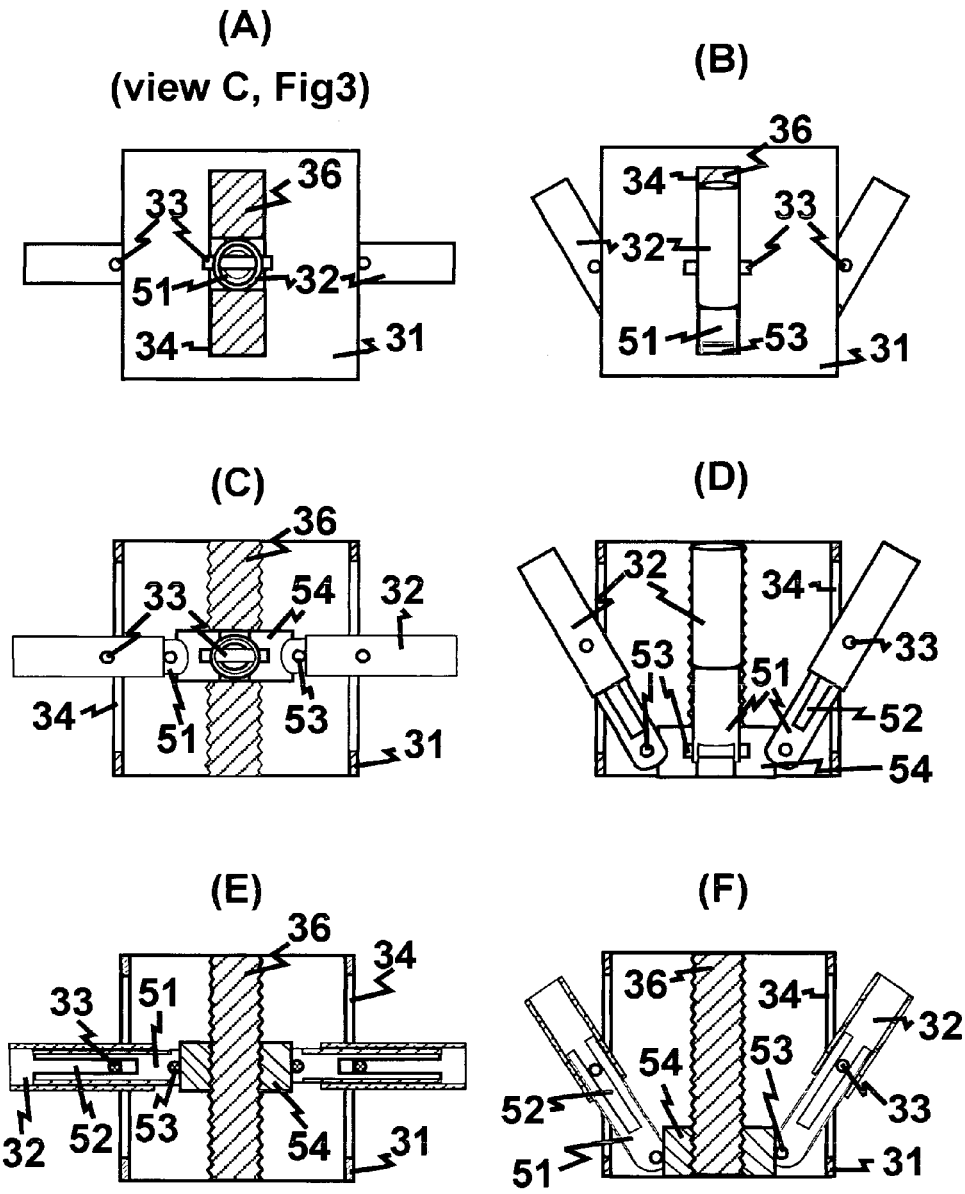
FIGS. 11A to 11F illustrates various views of a part of the assembled trunk in both the extended and collapsed position.
Figure 12:
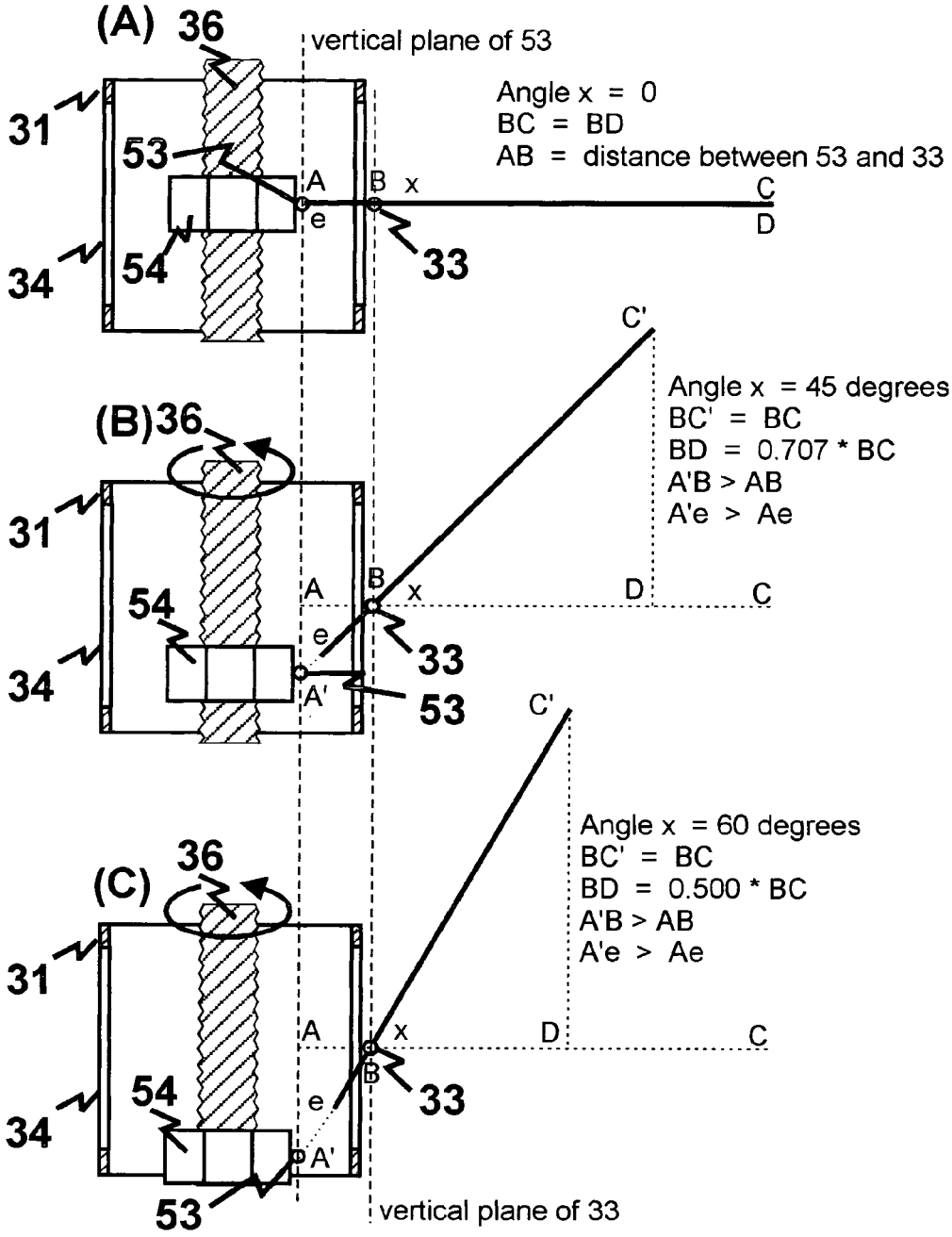
FIGS. 12A to 12C illustrates the change in the tree's diameter as the branches are moved from the extended to the collapse position.

FIG. 10 is a top view illustrating the placement of the branch translator assembly (FIGS. 4, 50) on the threaded inner core (36) and the placement of its branch extenders (51) within the branch guides (32). The view is identified on FIG. 3 as B—B. FIG. 10 shows how the branch extender (51) fits into the branch guide (32) and bypasses the outer pivot bar (33) by way of the branch extender slot (52). FIG. 10 also illustrates how the branch extender (51) is attached to the threaded branch translator (54) by way of the inner pivot bar (53).

Operation—FIGS. 11 and 12, and FIGS. 1 and 2

FIG. 11A to FIG. 11F illustrates the movement of the branch translator assembly (FIGS. 4, 50) in relation to the threaded inner core (36).

FIG. 11A shows a close view of the trunk (FIGS. 3, 30) where the branches (25, not shown) are attached to the branch guides (32). In FIGS. 11A, 11C, and 11E, the branch guides (32) are in the extended position. This corresponds to the branch position illustrated in FIG. 1, which is essentially perpendicular to the tree's trunk.

In FIGS. 11B, 11D, and 11F, the branch guides (32) are rotated around the outer pivot bars (33) into the collapsed position. As the branch guides (32) move from the extended to the collapsed position, the attached branches (25, not shown) rotate upward and closer to the trunk. This corresponds to the branch position illustrated in FIG. 2, which is close to and approaching a parallel position in relation to the tree's trunk.

FIG. 11C and FIG. 11D are cross sectional views through the outer trunk shell (31). These views reveal the movement of the branch translator assembly (FIGS. 4, 50) in relation to the threaded inner core (36) and the branch guide (32). The threaded inner core (36) is rotated around its central axis by the inner core gear (FIGS. 6, 38, not shown). As the threaded inner core (36) rotates, the threaded branch translator (54) cannot rotate because the attached branch extenders (51) pass through and are restricted by the outer shell slots (34). This converts the rotational motion of the threaded inner core (36) to a linear motion of the threaded branch translator (54). The threaded branch translator (54) moves down the threaded inner core (36) from the extended position (FIG. 11C) to the collapsed position (FIG. 11D). As 54 moves down 36, the branch extender (51) rotates around the inner pivot bar (53). This vertical rotation of 51 in turn rotates the branch guide (32) around the outer pivot bar (33). In addition, the downward movement of 54 pulls the branch extender (51) along the inside of the branch guide (32). This maintains an expandable link between the inner (53) and outer (33) pivot bars.

FIG. 11E and FIG. 11F are cross sectional views through the outer trunk shell (31), the branch translator assembly (FIGS. 4, 50), and the threaded inner core (36). They are presented to better illustrate the movement of the branch extender (51) within the branch guide (32). As the threaded branch translator (54) moves down the threaded inner core (36), the branch extender (51) slides along the inside diameter of the branch guide (32). The branch extender slot (52) allows the branch extender (51) to extend beyond the outer pivot bar (33). This allows for a fuller range of motion for the branch extender (51) and a greater rotation of the branch guide (32).

FIG. 11A to F illustrates how the rotational motion of the threaded inner core (36) is translated into a linear motion of the threaded branch translator (54). Since all the branches are connected to the branch extender assembly (FIGS. 4, 50), the rotation of the threaded inner core (36) moves all the branch guides (32) simultaneously. The direction of the rotation determines the direction of the linear motion. The number of rotations controls the length of the linear motion. The speed of rotation controls the speed of the linear motion. Also, the motion is smooth and continuous. Overcoming inertia is not a problem. This prevents any jerky movements that could disrupt or damage delicate decorations. Finally, the conservation of energy laws apply. When a rotational movement is converted to a linear movement, a proportional increase in force is achieved. This allows the small applied force used to rotate the threaded inner core (36) to be translated into a much larger force used to lift and lower fully decorated branches.

FIGS. 12A to 12C demonstrates the full range of motion achieved by the invention. FIG. 12A illustrates the mechanism in the extended position. FIG. 12A is comparable to FIG. 11A where the branch extender (not shown), the branch guide (not shown), and the branch (not shown) are essentially perpendicular to the central axis of the threaded inner core (36). The distance between the inner pivot bar (53) and the outer pivot bar (33) is the length A-B. The distance that the branch guide (not shown) extends into the outer trunk shell (31) is length e-B. The distance between the end of the branch guide (not shown) and the inner pivot bar (53) is A-e. The distance that the branch (not shown) extends from the outer trunk shell (31) is length B-D. The length of the branch is B-C. In the extended position length B-D equals B-C. The angle (x) between B-D and B-C equals zero degrees.

In FIG. 12B, as the threaded inner core (36) rotates, the threaded branch translator (54) moves downward. The inner pivot bar (53) moves from A to A'. This causes line B-C (the branch) to rotate around the outer pivot bar (33) to a new position B-C'. This rotation causes the radius of the tree to decrease by the distance D-C. The angle (x) between B-C and B-C' increases. The distance between the end of the branch guide (not shown) and the inner pivot bar (53) increases from A-e to A'-e as A moves along the vertical plane of the inner pivot bar (53) which is parallel to the vertical plane of the outer pivot bar (33). At an x value of 45 degrees, the decrease from the original length B-D depicted in FIG. 12A is 29.3 percent.

In FIG. 12C, as the threaded inner core (36) further rotates, the threaded branch translator (54) moves further downward. Line B-C' further rotates, and angle x further increases. The distance between A'-e also increases. At an x value of 60 degrees the original length B-D depicted in FIG. 12A is reduced by 50 percent. The rotation and the radius reduction can be stopped at any point between the fully extended (x=0 degrees) and fully collapsed (x approaching 90 degrees) position.

Reversing the rotation of the threaded inner core (36) will cause the threaded branch translator (54) to move upward. This will reverse the rotation of B-C' and increase the length B-D until B-D equals B-C and x equals 0 degrees. Thus the radius of the tree can be alternately increased or decreased as the branch is extended and collapsed.

The advantages of this invention are:

1. It can substantially reduce the diameter of the tree.
2. Its branches can be made strong enough to support decorations.
3. Its method of branch movement provides sufficient force to rotate the heaviest branch.
4. Its branch movements are smooth and continuous and will not disturb or damage the applied decorations
5. Its branch movements allow for a multitude of branch positions from fully extended to fully collapsed.
6. Its branch movements are easily activated and controlled.
7. Its branches move simultaneously.
8. Its branches can be collapsed with the tree in the upright position.
9. It can be easily packed and transported to a storage area.
10. It can be designed to accommodate a multitude of branch and tree designs.

Accordingly, the reader will see that the artificial tree described above can be collapsed and extended a multitude of times without fatiguing the branches or the collapsing mechanism. The collapsing motion is achieved with a minimal applied force even when the branches are decorated with the heaviest ornaments. The branches of the tree move smoothly, continuously and simultaneously. This allows for a fully decorated tree to be reduced in diameter. The reduced diameter tree can be packed and transported to storage in its upright and fully decorated state. Further, the invention has the additional advantages in that 1. The rotational motion of the threaded inner core can be initiated manually or with a motorized assist.
2. The branches can be attached to the branch guides permanently or temporarily.
3. Branch placement along the trunk is flexible and can be symmetrical or asymmetrical.
4. The tree top can be permanently affixed or removable.
5. The outer shell of the tree trunk can be tapered or straight.
6. The outer shell of the trunk can be one continuous tube or constructed of stacked modules.
7. The branch guides and pivot bars on the outer trunk shell can be eliminated and the branches can be directly attached to the branch extenders.
8. The branch guides, pivot bars on the outer trunk shell and the branch extenders could be eliminated, and the branches could be pivotally attached to the branch translator.
9. The unthreaded inner core top and bottom caps could be set in bearings to reduce friction and wear.
10. The collapsed tree could be stored in a specially designed container that would protect it and its ornaments from damage.

Thus the scope of the invention should be determined by the appended claims and their legal equivalents, rather than by the examples given.

The invention claimed is:

1. An artificial tree with changing diameter, said tree comprising:

an outer trunk shell including a multitude of elongated openings along and around said outer trunk shell;

a threaded inner core within and coaxial to said outer trunk shell;

a multitude of threaded branch translators threaded onto said threaded inner core and aligned with said elongated openings in said outer trunk shell;

a multitude of branches passing through said elongated openings in said outer trunk shell and pivotally attached to said threaded branch translators such that said branches are free to rotate in planes parallel to the central axis of said outer trunk shell; and means for rotating said threaded inner core such that the rotational motion of said threaded inner core is transformed into linear motion of said threaded branch translators along the length of said threaded inner core causing said branches to rotate along the length of said outer trunk shell and changing the diameter of said tree.

2. The artificial tree of claim 1, said tree further comprising:

a multitude of branch extenders, said branch extenders are pivotally attached to said threaded branch translators such that said branch extenders are free to rotate in planes parallel to the central axis of said outer trunk shell while simultaneously restricting the rotational motion of said threaded branch translators because said branch extenders pass through said elongated opening.

3. The artificial tree of claim 2, said tree further comprising:

a multitude of branch guides, said branch guides are pivotally attached to said outer trunk shell at said elongated openings such that said branch guides are free to rotate in planes parallel to the central axis of said outer trunk shell, said branch extenders are coaxially and slidably joined to said branch guides such that said branch extenders are contiguous to said branch guides during rotation.

4. The artificial tree of claim 1 wherein said means for rotating said threaded inner core includes a geared coupling attached to said threaded inner core.

5. The artificial tree of claim 1 wherein said artificial tree has a removable top.

* * * * *